US006860070B2

(12) United States Patent
Gilleran

(10) Patent No.: US 6,860,070 B2
(45) Date of Patent: Mar. 1, 2005

(54) SUB-EXTERIOR WEATHERPROOFING FLASHING PANEL FOR UTILITY PIPES

(76) Inventor: William J. Gilleran, 27881 Trocadero, Mission Viejo, CA (US) 92692

( * ) Notice: Subject to any disclaimer, the term of this patent is extended or adjusted under 35 U.S.C. 154(b) by 118 days.

(21) Appl. No.: 10/322,012

(22) Filed: Dec. 17, 2002

(65) Prior Publication Data

US 2003/0084628 A1 May 8, 2003

Related U.S. Application Data

(63) Continuation of application No. 09/725,523, filed on Nov. 29, 2000, now Pat. No. 6,543,186.

(51) Int. Cl.[7] ..... A47K 3/16

(52) U.S. Cl. ..... 52/35; 52/61; 52/62; 52/97; 52/220.8; 285/64; 285/39; 285/158

(58) Field of Search ..... 52/61, 62, 97, 52/220.8; 285/39, 64, 158

(56) References Cited

U.S. PATENT DOCUMENTS

| | | | | |
|---|---|---|---|---|
| 791,068 A | | 5/1905 | Baker | |
| 2,800,850 A | | 7/1957 | McKann | |
| 4,526,407 A | | 7/1985 | Kifer | |
| 4,874,189 A | * | 10/1989 | Gardner | 285/39 |
| 4,903,997 A | | 2/1990 | Kifer | |
| 4,965,971 A | | 10/1990 | Jean-Jacques et al. | |
| 5,246,255 A | | 9/1993 | Forbes et al. | |
| 5,309,579 A | | 5/1994 | Nelson | |
| 5,526,619 A | | 6/1996 | Vagedes | |
| 5,803,508 A | * | 9/1998 | Lowella | 285/64 |
| 5,918,431 A | | 7/1999 | Schiedegger et al. | |
| 5,946,863 A | | 9/1999 | Bullard | |
| 6,378,910 B1 | * | 4/2002 | Maiman | 285/46 |
| 6,543,186 B2 | * | 4/2003 | Gilleran | 52/35 |

* cited by examiner

*Primary Examiner*—Carl D. Friedman
*Assistant Examiner*—Yvonne M. Horton
(74) *Attorney, Agent, or Firm*—Stetina Brunda Garred & Brucker

(57) ABSTRACT

A utility pipe encasement collar for preventing water from weather related sources such as rain and snow from traveling rearwardly along the exterior surface of the utility pipe and into a building structure from which the pipe projects. In a first embodiment the collar includes a weather proof elastomeric sheet material having an opening therethrough sized to inherently huggingly accommodate a utility pipe passed through the opening, and a generally rigid support member extending laterally from the elastomeric sheet material. In a second embodiment the collar includes a first generally rigid weather proof sheet member having an upright generally U-shape opening therethrough and a second generally rigid weather proof sheet member having an inverted generally U-shape opening therethrough. The upright and inverted openings are alignably slidable opposite each other while the utility pipe is disposed within both U-shaped openings to thereby provide a generally perpendicular collar surrounding the pipe as formed by the sheet members.

13 Claims, 4 Drawing Sheets

Fig. 1
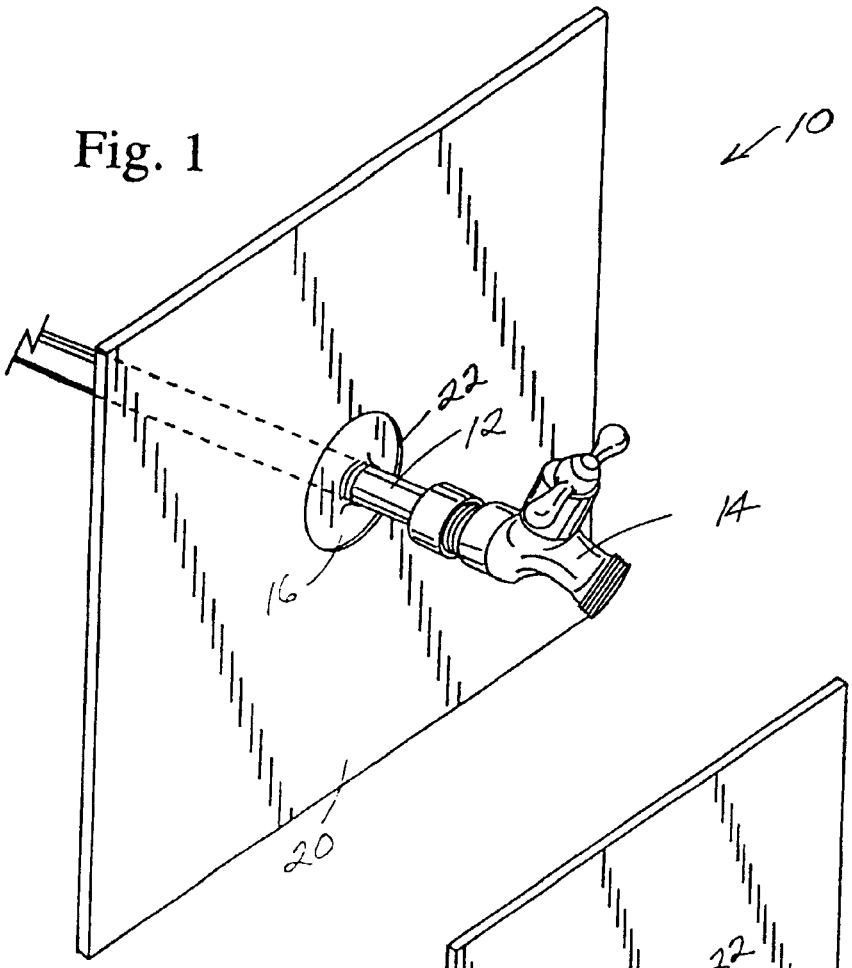
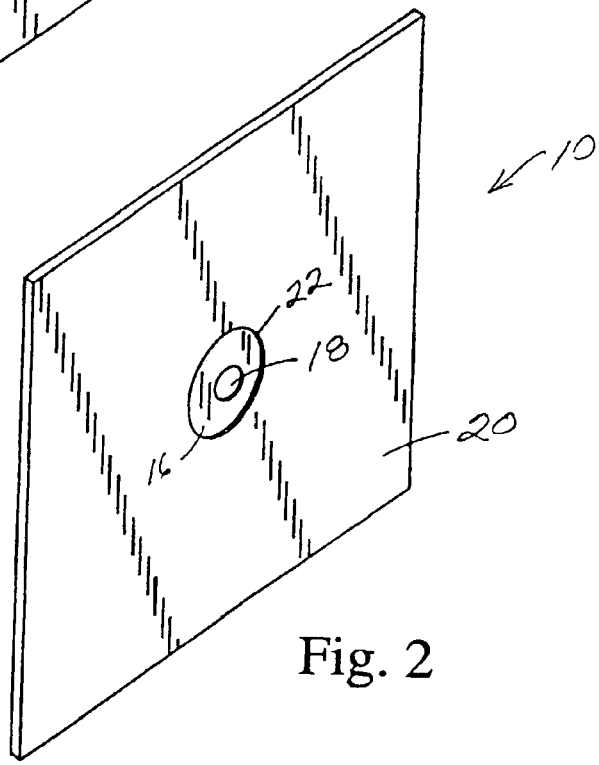
Fig. 2

SUB-EXTERIOR WEATHERPROOFING FLASHING PANEL FOR UTILITY PIPES

CROSS-REFERENCE TO RELATED APPLICATIONS

The present application is a continuation of U.S. patent application Ser. No. 09/725,523 entitled SUB-EXTERIOR WEATHERPROOFING FLASHING PANEL FOR UTILITY PIPES filed Nov. 29, 2000 now U.S. Pat. No. 6,543,186, the entirety of the disclosure of which is expressly incorporated herein by reference.

STATEMENT RE: FEDERALLY SPONSORED RESEARCH/DEVELOPMENT

Not Applicable

BACKGROUND OF THE INVENTION

The present invention relates in general to prohibiting weather-related moisture from traveling rearwardly along the outside surface of a utility pipe such as a water or gas pipe, and in particular to a utility pipe encasement collar positionable immediately behind the pipe opening and integrateable with construction material there around to provide consistent weatherproofing of the pipe.

In the construction of houses, commercial buildings, and the like, various utility/plumbing pipes such as water pipes, gas pipes, drain pipes, etc., extend through the walls of the building and terminate exterior of the building so as to be accessible by a user. When exteriorly terminated, these pipes extend through insulation, between wall boards, potentially within ceiling and floor structures, and in other critical places where a dry environment is extremely important for both structural and safety considerations. The exteriorly exposed pipe ends are periodically subjected to water sources, whether from rain, snow, lawn sprinklers, vandalism, or other sources. Such water has a natural tendency to travel rearwardly on the exterior of the pipe for attempted entry into the building structure. If such water enters through the exterior building wall, it can cause substantial damage to insulation; dry wall; wood moldings; flooring and carpeting on the interior of the building.

The importance of attempting to mitigate water entry through such pipe terminations has been recognized by the building industry with various attempts being recently made to prevent such rearward water travel. One presently employed approach utilizes caulking material applied at the interface of the pipe with lathing paper disposed immediately behind the pipe outlet. Thereafter, stucco or other exterior finish material is applied over the lathing paper to be adjacent to the exposed pipe length while allowing the pipe end to be exteriorly accessible. Over time, however, such caulking can eventually crack and break, and, when this occurs, water can freely travel along the pipe surface and into the interior of the building structure.

A second common approach is individually performed at every pipe outlet at a job site and entails hand measuring and cutting of sheet metal to create flashing thereafter fitted around the pipe behind the pipe opening and nailed in place and caulked. Once again, although this approach can work initially, the caulking material eventually gives way or is not initially caulked properly allows water to travel rearwardly over the pipe surface and into the structure. In this latter situation, and depending upon pipe material and flashing material such as copper and sheet metal respectively, electrolysis can occur as an interaction of the pipe material (e.g., copper) and the flashing metal (e.g. sheet metal).

In view of the above described conditions and consequences of prior art solutions, it is apparent that a need is present for a weatherproofing solution that is not subject to installation error and lasts the life of the building structure. Accordingly, a primary object of the present invention is to provide a utility (e.g., water, electrical conduit, drain and/or gas) pipe encasement device that prevents rearward water flow over the exterior surface of the pipe and into the interior of a building.

Another object of the present invention is to provide an encasement device that accommodates a range of pipe diameters while not losing effectiveness.

Yet another object of the present invention is to provide an encasement device whose structure is integrateable with and securable within exterior wall construction material.

These and other objects of the present invention will become apparent throughout the description thereof which now follows.

BRIEF SUMMARY OF THE INVENTION

The present invention comprises a utility pipe encasement collar for preventing water from weather related sources such as rain, snow and irrigation sprinklers from traveling rearwardly along the exterior surface of the utility pipe and into a building structure from which the pipe projects. In a first embodiment the collar comprises a weather proof elastomeric sheet material having an opening therethrough sized to inherently huggingly accommodate a utility pipe passed through the opening, and a generally rigid support member extending laterally from the elastomeric sheet material. The sheet material is non-limitedly exemplified by rubber and plastic film, while the support member is non-limitedly exemplified by any rigid plastic material which is preferably in the form of a sheet. In a second embodiment the collar comprises a first generally rigid weather proof sheet member having an upright generally U-shape opening therethrough and a second generally rigid weather proof sheet member having an inverted generally U-shape opening therethrough. The upright and inverted openings are alignably slidable opposite each other while the utility pipe is disposed within both U-shaped openings to thereby provide a generally perpendicular collar surrounding the pipe as formed by the sheet members.

Installation of the encasement collar of the present invention occurs prior to finishing the outside wall through which the utility pipe projects. In particular, the pipe first is conventionally secured within building framework to prohibit lateral and axial movement. Thereafter, the encasement collar is installed to be positioned as described above with the support member (first embodiment) or sheet (second embodiment) extending laterally for nail securement to any nearby building framework and for covered encasement by exterior wall finish material such as lathing paper-thereafter covered with stucco, wood siding, concrete, brick, or the like. In this manner, an easily applied, permanent effective water barrier is achieved to prohibit water migration into the building structure.

BRIEF DESCRIPTION OF THE DRAWINGS

An illustrative and presently preferred embodiment of the invention is shown in the accompanying drawings in which:

FIG. 1 is a perspective view of a first embodiment of a utility pipe encasement collar in place over a utility delivery pipe;

FIG. 2 is a perspective view of the encasement collar alone of FIG. 1;

DETAILED DESCRIPTION OF THE PREFERRED EMBODIMENTS

Figure 3:
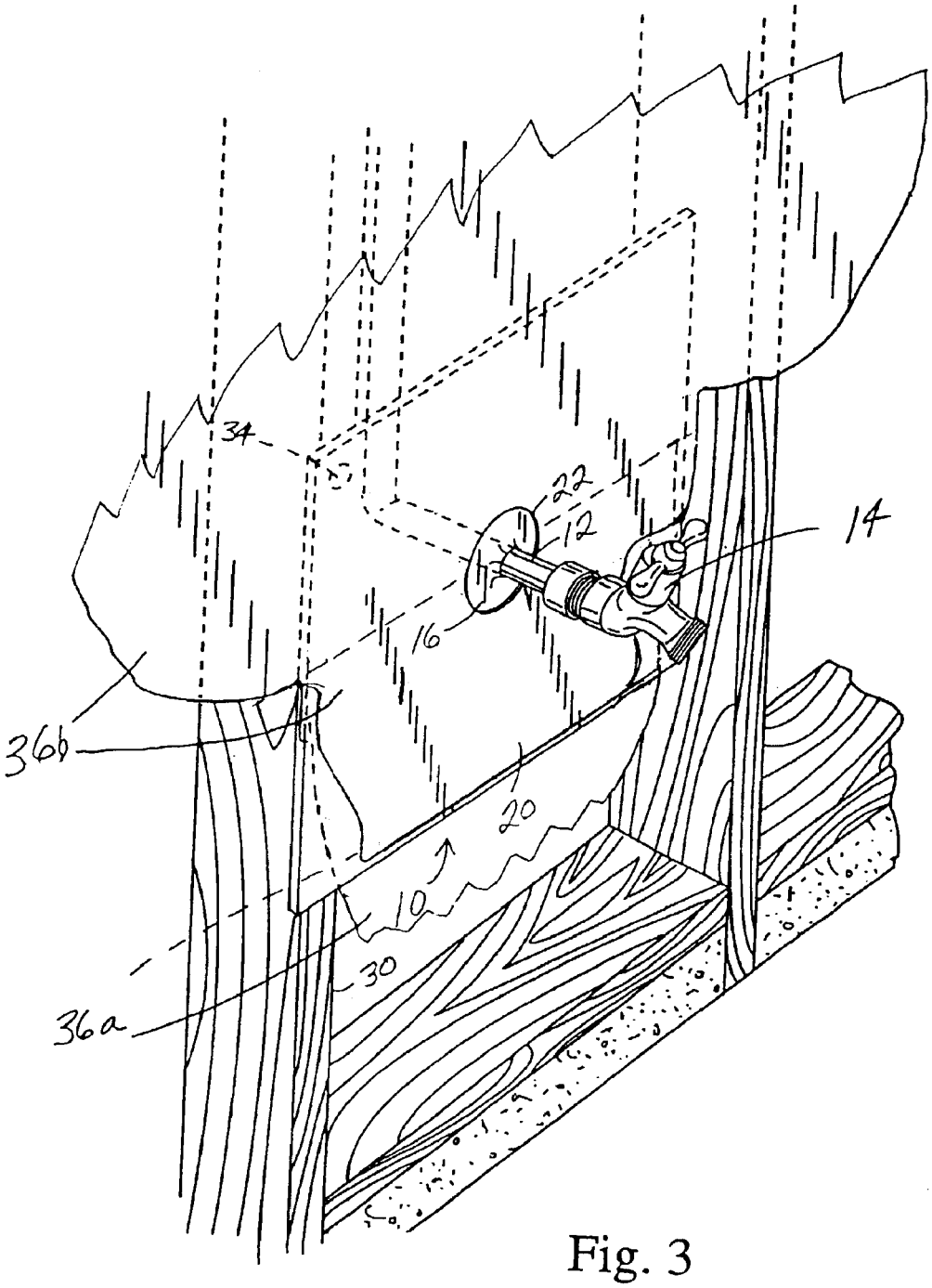
FIG. 3 is a perspective view partially in section of the encasement collar of FIG. 1 further installed in a building structure.

Referring first to FIGS. 1–3, a pipe encasement collar 10 shown. FIGS. 1 and 3 illustrate the collar 10 in place on a water pipe 12 behind an end opening of the pipe 12 here illustrated as a conventional hose connector 14. The collar 10 has an elastomeric material 16 with an opening 18 sized to permit passage of the pipe 12 there through and sufficiently small to huggingly surround the pipe 12 such that a water-tight seal at the interface of the pipe 12 and the elastomeric material 16 is formed. Rubber and plastic film having such elastomeric properties are two examples of usable elastomeric material. A rigid support member extends laterally from the elastomeric material 16, and preferably is a plastic support sheet 20 with the elastomeric material 16 centrally disposed therein as shown. Such configuration can be achieved by differing processes such as injection molding insert techniques or as by adhesively securing the elastomeric material 16 to the support sheet 20 across a preformed aperture 22 of the sheet 20.

Figure 4:
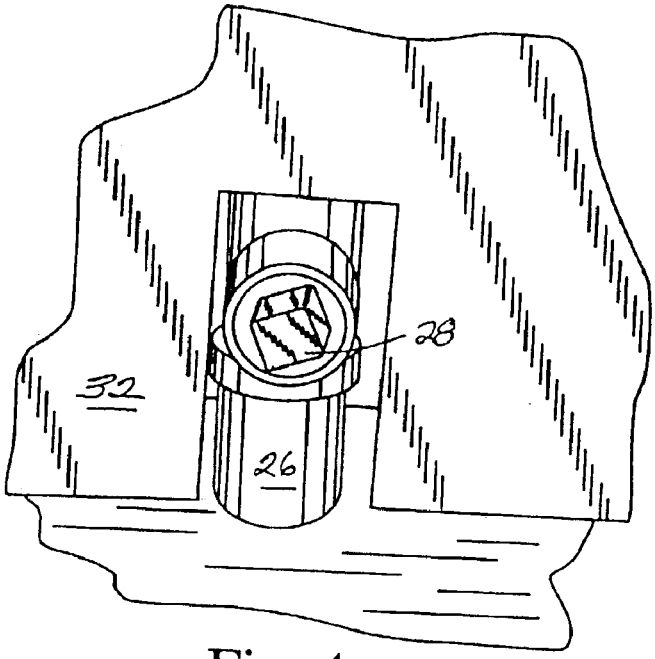
FIG. 4 is a perspective view of a utility delivery pipe without rearward water travel protection.
Figure 5:
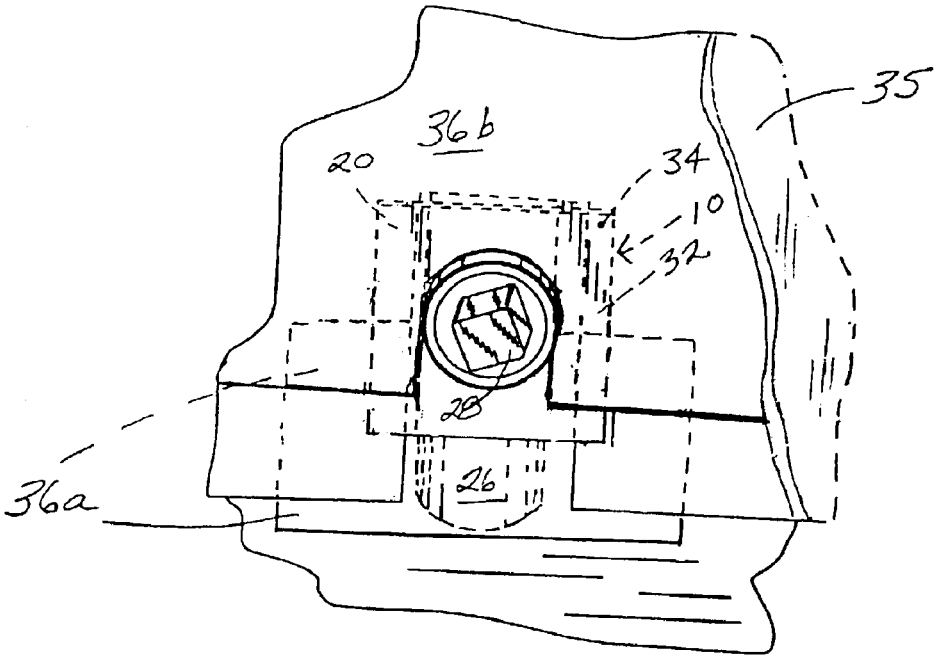
FIG. 5 is a perspective view of the delivery pipe of FIG. 4 with an encasement collar in place.

FIGS. 4 and 5 show a direct access plumbing clean-out pipe 26 openable by removal of a standard wrenchable closure 28. FIG. 4 illustrates the pipe 26 prior to installation of the encasement collar 10 while FIG. 5 shows the collar 10 installed. Both FIGS. 3 and 5 illustrate use of the collar 10. In particular, after installation of the collar 10 around the pipe 12, 26 during building construction, the support sheet 20 is secured to surrounding framework 30, 32 or the like with a nail 34 situated above the projecting pipe end. Thereafter, lath paper 36*a* is provided from below behind the support sheet 20 preferably vertically upward to the pipe 12, 26. Additional lath paper 36*b* is provided from vertically above over the front of the support sheet 20 extending below the bottom edge with a cut-out portion for surrounding and extending beneath the projecting pipe 12, 26 and preferably extending downward to be adjacent to the lower edge of the support sheet 20. Stucco 35 or other finishing material for the exterior wall is applied-directly on and over the exposed portions of the support sheet 20 and lathing paper, thereby making the collar 10 an integral permanent component of the wall. When water travels rearwardly on the exterior of the pipe 10 from its opening, the water simply encounters the elastomeric material 16 in sealing elasticized engagement with the exterior surface of the pipe 12, 26. Because the water can travel rearwardly no further, it simply flows downwardly by gravitational force over the lath paper and to the ground. In this manner, internal dry conditions along the interiorly-situated utility delivery pipe 12, 26 are kept dry, while any water absorbed and held in the finishing material (e.g., stucco) cannot enter the building structure because the lathing paper prevents water passage.

Figure 6:
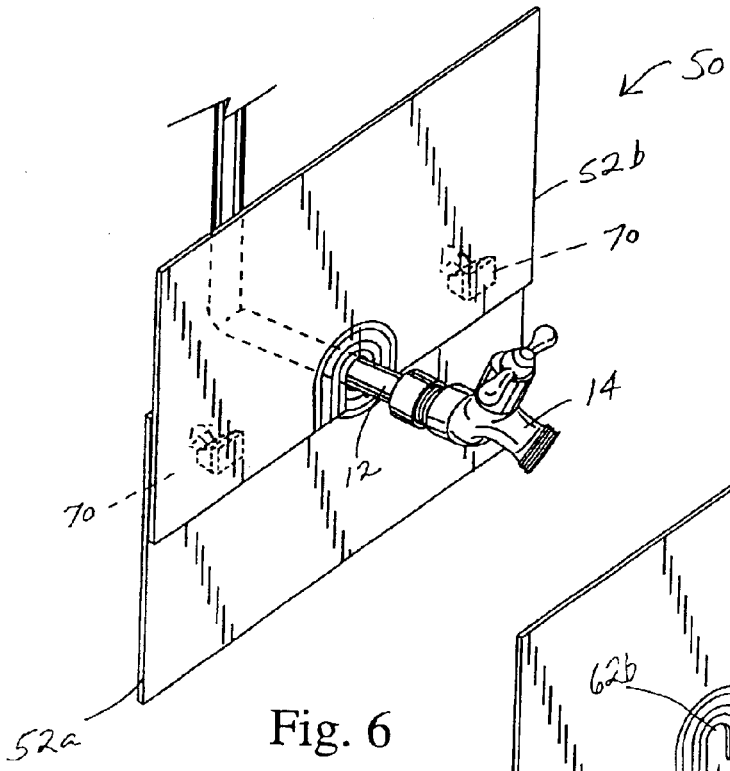
FIG. 6 is a front perspective view of a second embodiment of a utility pipe encasement collar in place over a utility delivery pipe.
Figure 7:
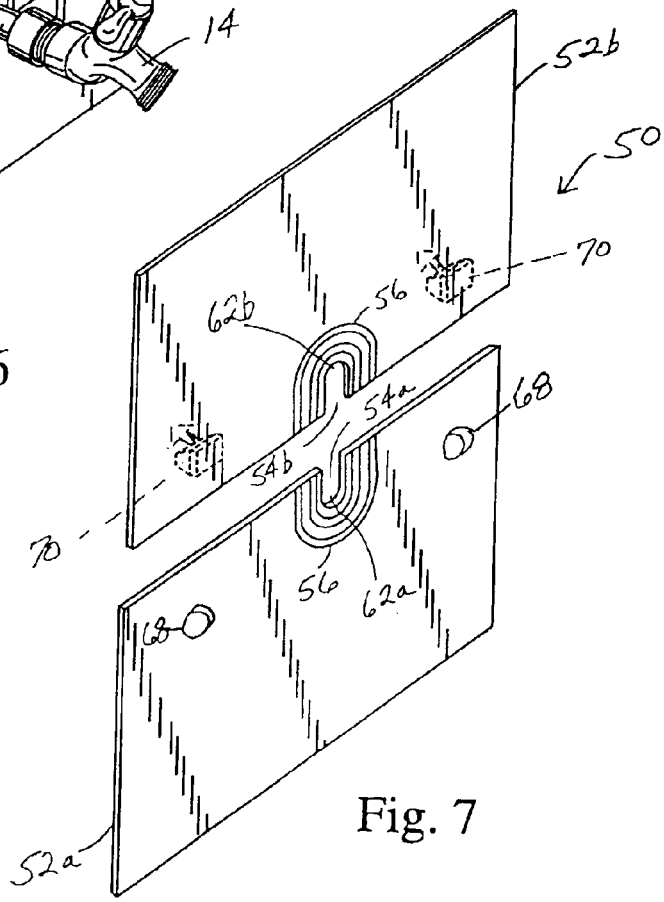
FIG. 7 is a front perspective view of the components of the encasement collar of FIG. 6.

FIGS. 6 and 7 illustrate a second embodiment of a utility pipe encasement collar 50. The collar 50 is constructed of a first generally rigid waterproof sheet member 52*a* having an upright generally U-shape opening 54*a* there through and a second generally rigid waterproof sheet member 52*b* having an inverted generally U-shape opening 54*b* likewise there through. Immediately adjacent each U-shape opening 54*a*, 54*b* are graduated scored marks 56 thereby permitting selected expansion of the size of each said opening 54*a*, 54*b* to accommodate a particular pipe diameter by cutting at an appropriate mark 56.

In use, the particular pipe size to be weatherproofed is determined and the appropriate scored marks 56 may be utilized to cut desired size openings in the sheet members 52*a* and 52*b*. The U-shape opening 54*a* of one sheet member 52*a* is then placed from below around a water delivery pipe 12 generally perpendicular to the longitudinal axis of the pipe 12. Thereafter, the other U-shape opening 54*b* of the other sheet member 52*b* is placed from above around the pipe 12 and over the sheet member 54*b* likewise in a perpendicular relationship as shown in FIG. 6 such that the curvatures 62*a*, 62*b* of the openings 54*a*, 54*b* encompass the pipe 12. The sheet members 52*a*, 52*b* are integrally retainable to each other by providing opposing openings 68 in one sheet member 52*a* to receive opposing alignable barbed/unidirectional projections 70 from the rear of the other sheet member 52*b* and thereby maintain the sheet members 52*a*, 52*b* in proper spatial relationship with each other. Once so positioned, the sheet members 52*a*, 52*b* are attached as with a nail to nearby framework or the like of the building structure. While an application of caulk material may be required at the close interface of the pipe 12 with the U-shape wall, the amount of caulk material needed generally is minimal and therefore long-lasting because of minimal deterioration potential. Lath paper is provided in the same manner as above described both behind and over the members 52*a*, 52*b*, and final finishing material such as stucco through which the pipe 12 projects is applied directly on and over exposed lath paper and sheet members 52*a*, 52*b*, thereby making the collar 50 an integral component of the wall for the life of the building structure.

As is thus apparent, encasement collar protection as described herein effectively prevents moisture entry within critical structural locations. While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A utility pipe encasement collar adapted to prevent water from traveling rearwardly from an exteriorly disposed end of a utility pipe along an exterior surface of the utility pipe, the collar comprising:

a support member sized and configured to be impermeable to water;

a means for preventing water from traveling rearwardly from the exteriorly disposed end of the utility pipe along the exterior surface of the utility pipe, said means being disposed substantially centrally within the support member; and an opening defined through said means;

wherein the support member is vertically oriented with respect to the utility pipe which is accommodated within said means by being passed through the opening so as to prevent the water from traveling rearwardly from the exteriorly disposed end of the utility pipe along the exterior surface thereof.

2. The collar of claim 1 wherein the support member is a generally rigid support member.

3. The collar of claim 1 wherein the support member has a generally rectangular configuration.

4. The collar of claim 1 wherein the support member is a plastic material.

5. A utility pipe encasement collar adapted to prevent water from traveling rearwardly from an exteriorly disposed end of a utility pipe along an exterior surface of the utility pipe, the collar comprising:

a support member sized and configured to be impermeable to water;

an elastomeric sheet material disposed substantially centrally within the support member; and an opening defined through the elastomeric sheet material;

wherein the support member is vertically oriented with respect to the utility pipe which is accommodated within the elastomeric sheet material by being passed through the opening so as to prevent the water from traveling rearwardly from the exteriorly disposed end of the utility pipe along the exterior surface thereof.

6. The collar of claim 5 wherein the elastomeric sheet material is rubber.

7. The collar of claim 5 wherein the elastomeric sheet material is a plastic film.

8. The collar of claim 5 wherein the support member is a plastic material.

9. The collar of claim 5 wherein the support member is a sheet configuration.

10. A utility pipe encasement collar adapted to prevent water from traveling rearwardly from an exteriorly disposed end of a utility pipe along an exterior surface of the utility pipe, the collar comprising:

a support member sized and configured to be impermeable to water;

a means for preventing water from traveling rearwardly from the exteriorly disposed end of the utility pipe along the exterior surface of the utility pipe, said means being disposed substantially centrally within the support member; and an opening defined through said means;

wherein the utility pipe is accommodated within said means by being passed through the opening so as to prevent the water from traveling rearwardly from the exteriorly disposed end of the utility pipe along the exterior surface thereof.

11. The collar of claim 10 wherein the support member is a generally rigid support member.

12. The collar of claim 10 wherein the support member has a generally rectangular configuration.

13. The collar of claim 10 wherein the support member is a plastic material.

* * * * *